US009545715B1

(12) United States Patent
Hsu

(10) Patent No.: US 9,545,715 B1
(45) Date of Patent: Jan. 17, 2017

(54) TOOL BOX

(71) Applicant: Huang-Tung Hsu, Taichung (TW)

(72) Inventor: Huang-Tung Hsu, Taichung (TW)

( * ) Notice: Subject to any disclaimer, the term of this patent is extended or adjusted under 35 U.S.C. 154(b) by 10 days.

(21) Appl. No.: 14/803,156

(22) Filed: Jul. 20, 2015

(51) Int. Cl.

| | |
|---|---|
| ***B65D 5/50*** | (2006.01) |
| ***B65D 85/28*** | (2006.01) |
| ***B25H 3/00*** | (2006.01) |
| ***B25H 3/02*** | (2006.01) |
| ***B65D 25/22*** | (2006.01) |

(52) U.S. Cl.
CPC ..... *B25H 3/006* (2013.01); *B25H 3/02* (2013.01); *B65D 25/22* (2013.01)

(58) Field of Classification Search
CPC ..... B25H 3/006; B25H 3/02; B25H 3/003; B65D 25/22
USPC ..... 206/372–383, 1.7–1.9, 443, 45.2, 45.23, 206/45.24; 221/87
See application file for complete search history.

(56) References Cited

U.S. PATENT DOCUMENTS 1,957,293 A * 5/1934 Reilly ..... A24F 15/12 206/250
2,039,559 A * 5/1936 Segal ..... A24F 15/18 206/236
2,528,743 A * 11/1950 Eggebrecht ..... A24F 15/16 206/250
4,798,310 A * 1/1989 Kasai ..... B43K 23/001 206/224
5,108,287 A * 4/1992 Yee ..... A61C 3/04 206/369
6,131,740 A * 10/2000 Huang ..... B25H 3/003 206/372
8,083,060 B1 * 12/2011 Liu ..... B25H 3/003 206/379
9,271,526 B2 * 3/2016 Liu ..... A24F 15/12
2006/0289319 A1 * 12/2006 Lin ..... A63D 15/10 206/315.1
2009/0255840 A1 * 10/2009 Lin ..... B25H 3/003 206/379

* cited by examiner

*Primary Examiner* — Chun Cheung
(74) *Attorney, Agent, or Firm* — Alan D. Kamrath; Kamrath IP Lawfirm, P.A.

(57) ABSTRACT

A tool box contains: a body, a fixing mount, a casing, a hanging seat, and a plurality of screwdrivers. The body includes two connecting notches and two limiting recesses formed on two sides of an inner wall thereof. The fixing mount includes two ends accommodated in the two limiting recesses and moving upwardly and downwardly in the two limiting recesses, and the fixing mount also includes a plurality of receiving holes and two resilient elements fitted on a bottom end thereof. The casing fits with the body and includes two cutouts, and the hanging seat includes two connection protrusions to connect with the two connecting notches of the body and the two cutouts of the casing. Each of the plurality of screwdrivers includes an extension fitted into each of the plurality of receiving holes of the fixing mount.

8 Claims, 9 Drawing Sheets

TOOL BOX

FIELD OF THE INVENTION

The present invention relates to a tool box which accommodates and displays a plurality of screwdrivers easily and brilliantly.

BACKGROUND OF THE INVENTION

A conventional tool box for accommodating a plurality of screwdriver contains a body and a casing rotatably connected with the body, wherein the body includes a fixing member for fixing the plurality of screwdrivers, hence the plurality of screwdrivers are accommodated in the tool box. However, it is difficult to remove the plurality of screwdrivers from the tool box, after the casing is rotated outwardly to take the plurality of screwdrivers out of the body.

The present invention has arisen to mitigate and/or obviate the afore-described disadvantages.

SUMMARY OF THE INVENTION

The primary objective of the present invention is to provide a tool box which rotates a hanging seat to abut against an indentation of each of a plurality of screwdrivers, thus accommodating and limiting each of the plurality screwdrivers in a body easily.

Further objective of the present invention is to provide a tool box which rotates the hanging seat to remove from the indentation of each of the plurality of screwdrivers, such that each screwdriver extends out of the body for easy removal from the tool box.

Another objective of the present invention is to provide a tool box in which the hanging seat is rotated so that an angle forms between the hanging seat and the body, so the tool box is placed on a table to display the plurality of screwdrivers brilliantly.

DETAILED DESCRIPTION OF THE PREFERRED EMBODIMENTS

Figure 1:
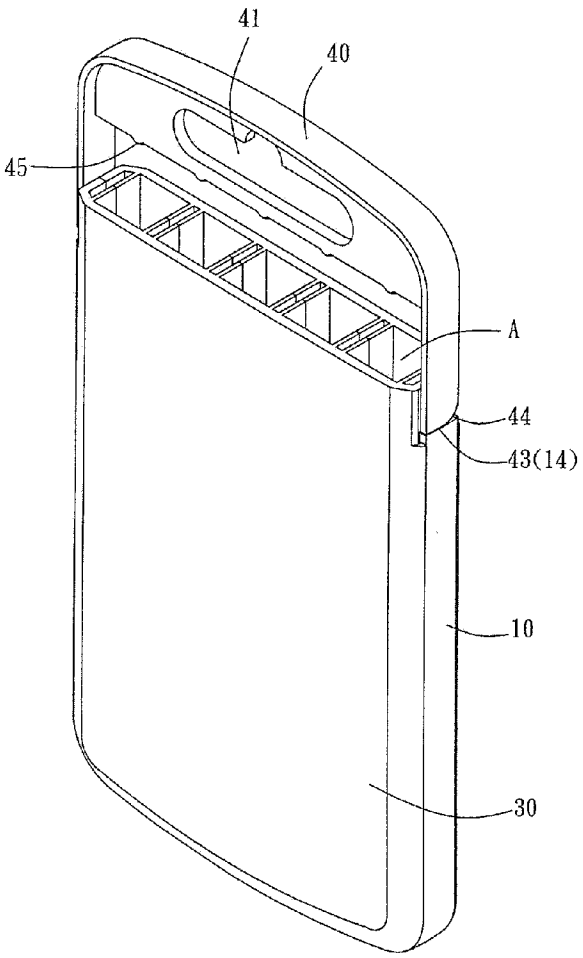
FIG. 1 is a perspective view showing the assembly of a tool box according to a preferred embodiment of the present invention.
Figure 2:
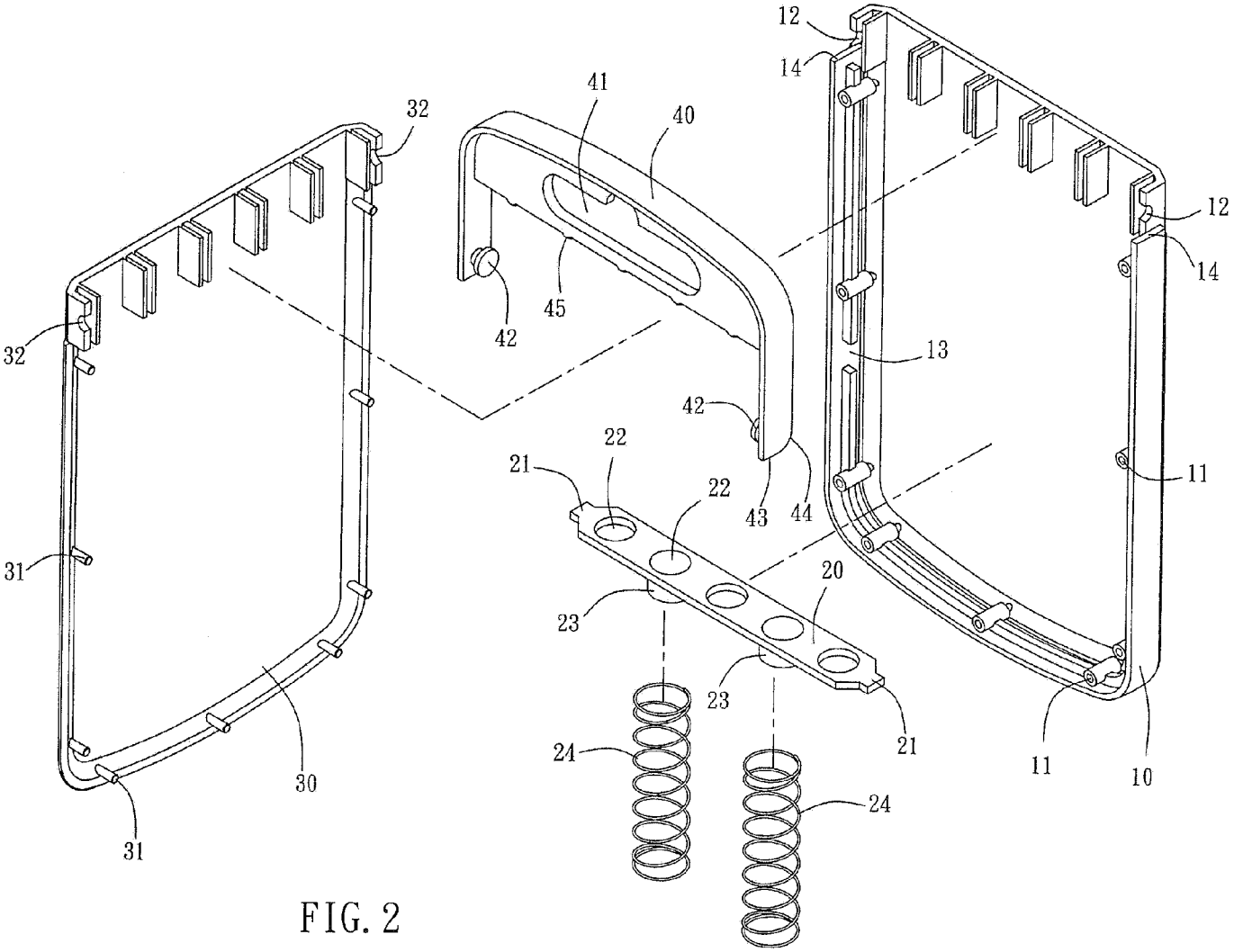
FIG. 2 is a perspective view showing the exploded components of the tool box according to the preferred embodiment of the present invention.
Figure 3:
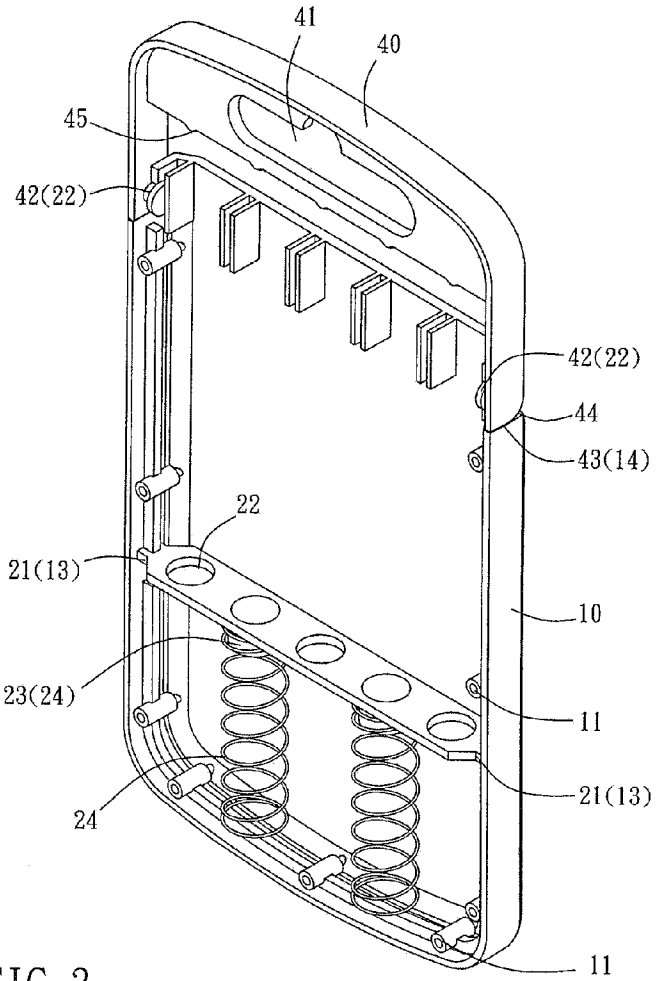
FIG. 3 is a perspective view showing the assembly of a part of the tool box according to the preferred embodiment of the present invention.

With reference to FIGS. 1 to 3, a tool box for accommodating screwdrivers according to a preferred embodiment of the present invention comprises: a body 10, a fixing mount 20, a casing 30, a hanging seat 40, and a plurality of screwdrivers 50.

The body 10 includes a plurality of fitting orifices 11 arranged around an inner wall thereof, two connecting notches 12 defined on two sides of an outer wall thereof adjacent to a top end of the outer wall of the body 10, two limiting recesses 13 formed on two sides of the inner wall of the body 10, and two abutting fringes 14 formed on the two sides of the outer wall of the body 10 below the two connecting notches 12.

The fixing mount 20 includes two limitation tabs 21 arranged on two ends thereof and accommodated in the two limiting recesses 13 of the body 10 to move upwardly and downwardly in the two limiting recesses 13, wherein the fixing mount 20 also includes a plurality of receiving holes 22 defined thereon and includes two locating posts 23 extending downwardly from a bottom end thereof to fit with two first ends of two resilient elements 24, wherein two second ends of the two resilient elements 24 are biased against a bottom end of the inner wall of the body 10.

The casing 30 includes a plurality of coupling columns 31 arranged around an inner wall thereof to fit with the plurality of fitting orifices 11 of the body 10, and the casing 30 also includes two cutouts 32 formed on two sides of an outerwall thereof proximate to a top end of the outer wall of the casing 30.

The hanging seat 40 includes a through hole 41 defined thereon proximate to a top end of an inner wall thereof, the hanging seat 40 also includes two connection protrusions 42 extending inwardly from two sides of the inner wall thereof adjacent to a bottom end of the inner wall of the hanging seat 40, such that the two connection protrusions 42 connect with the two connecting notches 12 of the body 10 and the two cutouts 32 of the casing 30. The hanging seat 40 further includes two straight sections 43 parallelly arranged on two sides of an outer wall thereof, an arcuate section 44 formed on a top end of the outer wall of the hanging seat 40, and a plurality of pressing bosses 45 arranged proximate to the through hole 41.

Each of the plurality of screwdrivers 50 includes an extension 51 fitted into each of the plurality of receiving holes 22 of the fixing mount 20 and includes an indentation 52 defined on a top end thereof.

Figure 4:
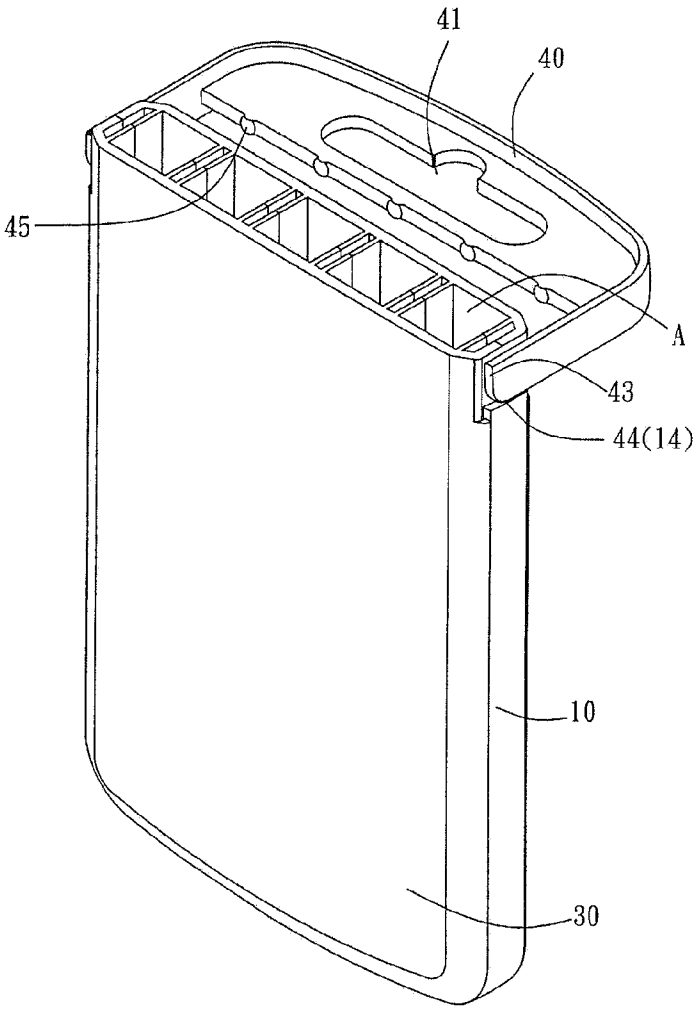
FIG. 4 is a perspective view showing the operation of the tool box according to the preferred embodiment of the present invention.
Figure 5:
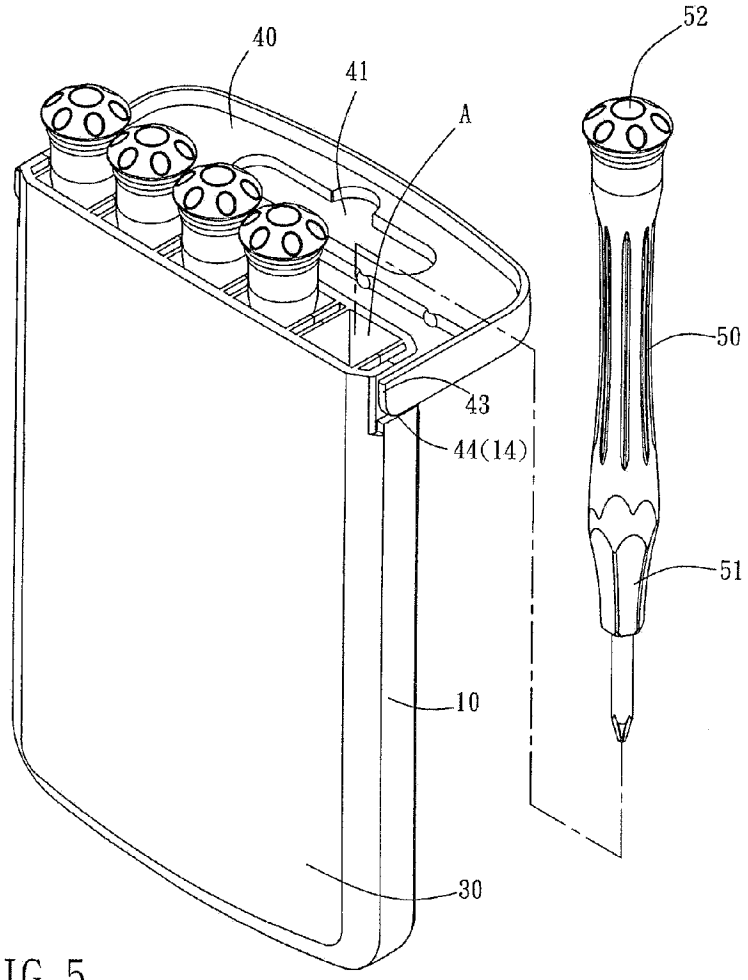
FIG. 5 is another perspective view showing the operation of the tool box according to the preferred embodiment of the present invention.

In assembly, the two first ends of the two resilient elements 24 are fitted with the two locating posts 23 of the fixing mount 20, and the two limitation tabs 21 of the fixing mount 20 are accommodated in the two limiting recesses 13 of the body 10, thereafter the two connection protrusions 42 of the hanging seat 40 are connected with the two connecting notches 12 of the body 10, and the plurality of coupling columns 31 of the casing 30 are fitted with the plurality of fitting orifices 11 of the body 10, such that the fixing mount 20 is defined between the body 10 and the case 30 to move upwardly and downwardly in the two limiting recesses 13 of the body 10. In addition, the two connection protrusions 42 of the hanging seat 40 are further connected with the two cutouts 32 of the casing 30 so as to rotate along the two connecting notches 12 of the body 10 and the two cutouts 32 of the casing 30. Referring to FIGS. 4 and 5, the plurality of coupling columns 31 of the casing 30 are fitted with the plurality of fitting orifices 11 of the body 10 to form a plurality of inserting apertures A, hence each of the plurality of screwdrivers 50 is inserted into each of the plurality of inserting apertures A, and the extension 51 of each screwdriver 50 is fitted into each of the plurality of receiving holes 22 of the fixing mount 20.

Figure 6:
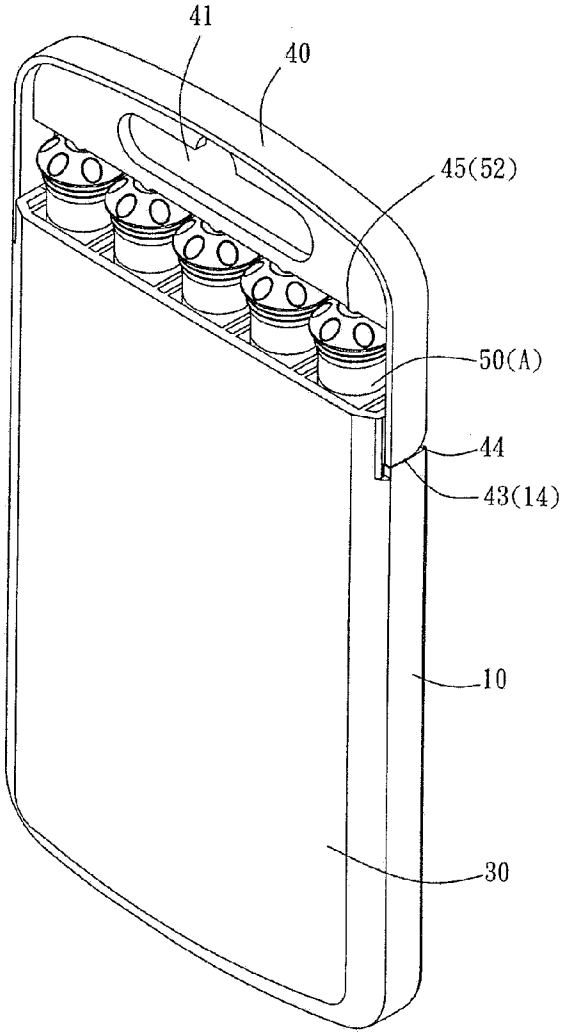
FIG. 6 is also another perspective view showing the operation of the tool box according to the preferred embodiment of the present invention.
Figure 8:
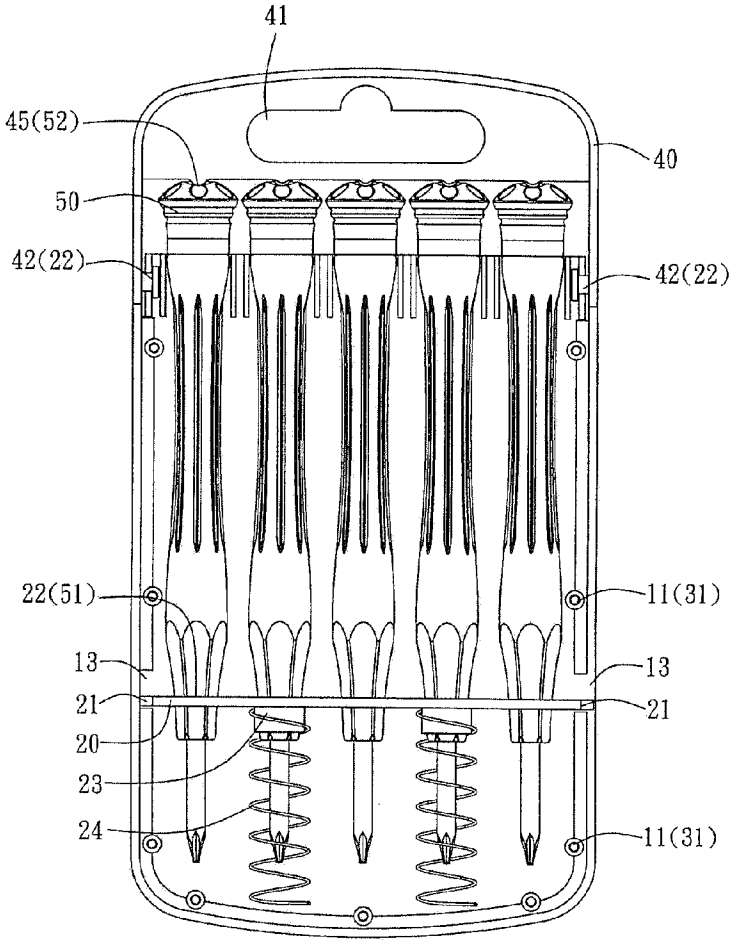
FIG. 8 is another side plane view of FIG. 6.
Figure 7:
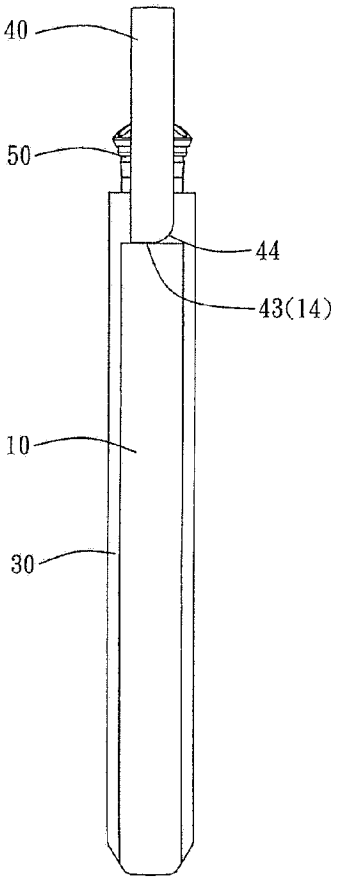
FIG. 7 is a side plane view of FIG. 6.

As shown in FIGS. 6 to 8, each screwdriver 50 is inserted into each inserting aperture A, and one of the plurality of screwdrivers 50 is pressed downwardly to force the fixing mount 20 downwardly (Due to the two limitation tabs 21 of the fixing mount 20 are accommodated in the two limiting recesses 13 of the body 10, the fixing mount 20 moves upwardly and downwardly in the two limiting recesses 13), thereafter the hanging seat 40 is rotated counterclockwise by rotating the two connection protrusions 42 along the two connecting notches 12 and the two cutouts 32 so that the two straight sections 43 of the hanging seat 40 abut against the two abutting fringes 14 of the body 10, and the two resilient elements 24 are pressed downwardly and bounce upwardly by using their reaction elasticity until the indentation 52 of each screwdriver 50 abuts against each pressing boss 45 of the hanging seat 40, thus fixing and accommodating the plurality of screwdrivers 50 easily.

Figure 10:
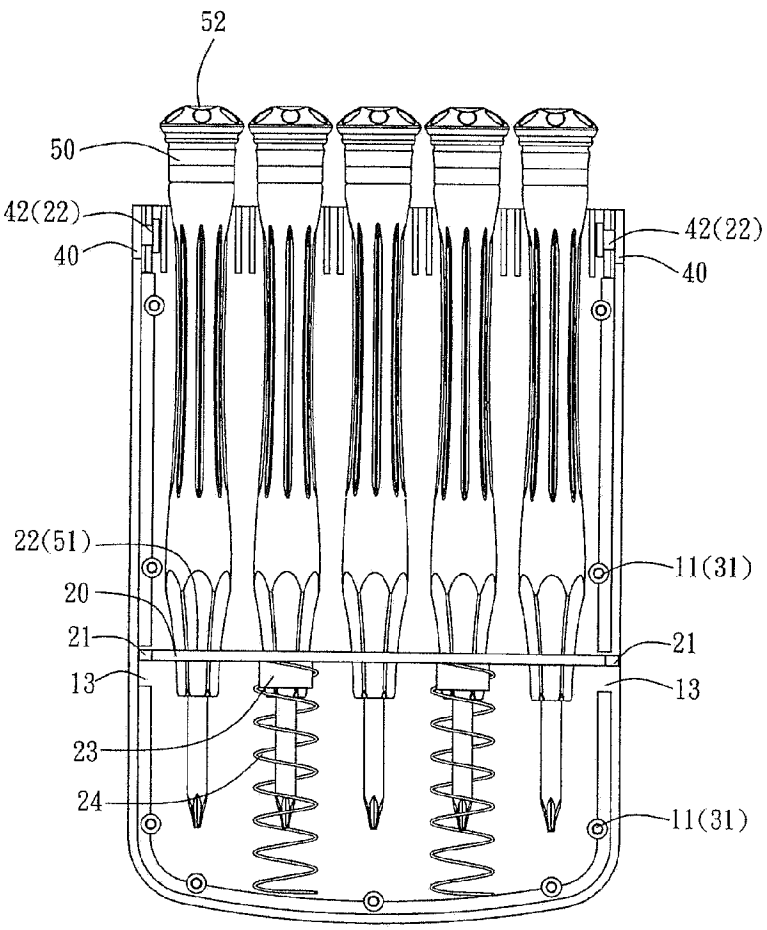
FIG. 10 is another side plane view showing the operation of the tool box according to the preferred embodiment of the present invention.
Figure 9:
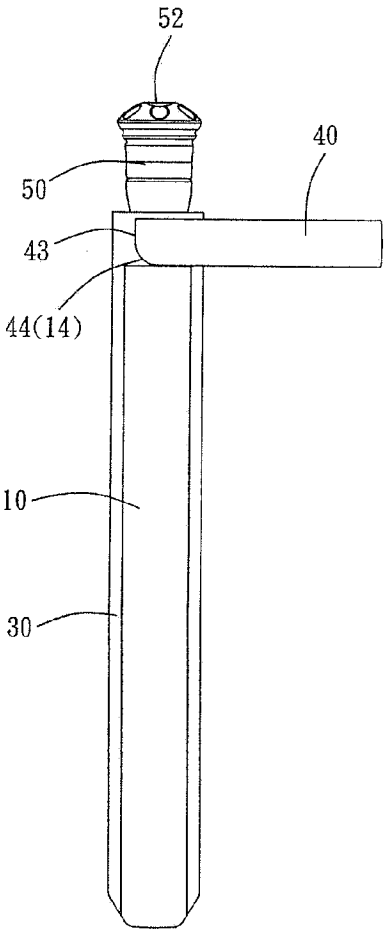
FIG. 9 is a side plane view showing the operation of the tool box according to the preferred embodiment of the present invention.

As shown in FIGS. 9 and 10, the hanging seat 40 is rotated clockwise (in the meantime, the hanging seat 40 does not interfere with the body 10 by using its arcuate section 44) so that each pressing boss 45 of the hanging seat 4 removes from the indentation 52 of each screwdriver 50, and the two resilient elements 24 push the fixing mount 20 to move upwardly by using their reaction elasticity, hence each screwdriver 50 is actuated by the fixing mount 20 to extend out of the tool box, thus taking each screwdriver 50 out of the tool box easily.

Figure 11:
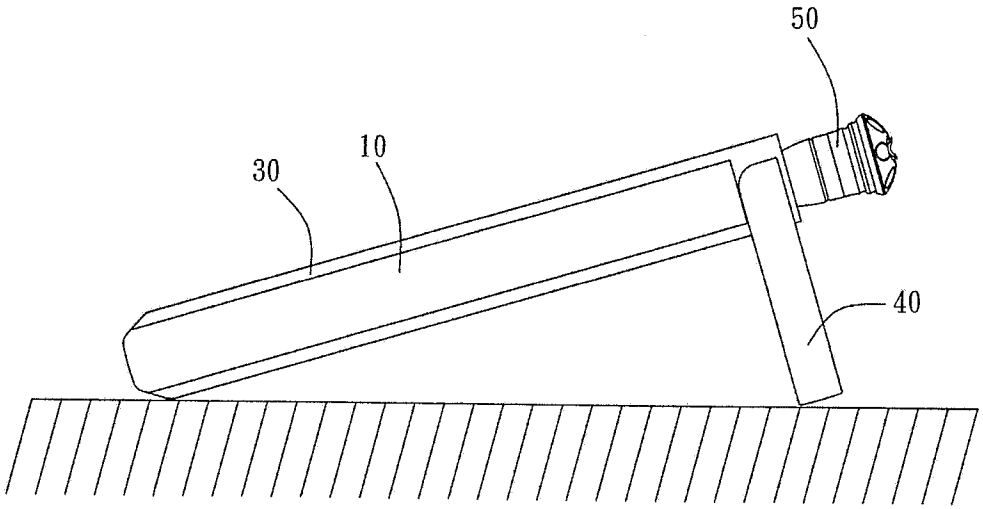
FIG. 11 is a side plane view showing the application of the tool box according to the preferred embodiment of the present invention.

Furthermore, the tool box is hung by ways of the through hole 41 for display purpose. Preferably, as illustrated in FIG. 11, when rotating the hanging seat 40 clockwise to form an angle between the hanging seat 40 and the body 10, the tool box is placed on a table to display the plurality of screwdrivers 50 brilliantly.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A tool box comprising: a body, a fixing mount, a casing, a hanging seat, and a plurality of screwdrivers; wherein the body includes two connecting notches defined on two sides of an outer wall thereof adjacent to a top end of the outer wall of the body, the body also includes two limiting recesses formed on two sides of an inner wall thereof;

the fixing mount includes two ends accommodated in the two limiting recesses of the body to move upwardly and downwardly in the two limiting recesses, and the fixing mount also includes a plurality of receiving holes defined thereon and includes two resilient elements fitted on a bottom end thereof;

the casing fits with the body and includes two cutouts formed on two sides of an outer wall thereof proximate to a top end of the outer wall of the casing;

the hanging seat includes two connection protrusions extending inwardly from two sides of an inner wall thereof adjacent to a bottom end of the inner wall of the hanging seat, such that the two connection protrusions connect with the two connecting notches of the body and the two cutouts of the casing; and each of the plurality of screwdrivers includes an extension fitted into each of the plurality of receiving holes of the fixing mount.

2. The tool box as claimed in claim 1, wherein the body also includes a plurality of fitting, orifices arranged around the inner wall thereof, and the casing includes a plurality of coupling columns arranged around an inner wall thereof to fit with the plurality of fitting orifices of the body.

3. The tool box as claimed in claim 1, wherein the body further includes two abutting fringes formed on the two sides of the outer wall thereof below the two connecting notches, and the hanging seat further includes two straight sections parallelly arranged on two sides of an outer wall thereof and includes an arcuate section formed on a top end of the outer wall of the hanging seat.

4. The tool box as claimed in claim 1, wherein the fixing mount also includes two limitation tabs arranged on two ends thereof and accommodated in the two limiting recesses of the body.

5. The tool box as claimed in claim 1, wherein the fixing mount further includes two locating posts extending downwardly from a bottom end thereof to fit with two first ends of the two resilient elements, and two second ends of the two resilient elements are biased against a bottom end of the inner wall of the body.

6. The tool box as claimed in claim 1, wherein the hanging seat includes a through hole defined thereon proximate to a top end of the inner wall of the hanging seat.

7. The tool box as claimed in claim 1, wherein the hanging seat further includes a plurality of pressing bosses arranged proximate to the through hole, and each of the plurality of screw drivers includes an indentation defined on a top end thereof to abut against each of the plurality of pressing bosses.

8. The tool box as claimed in claim 2, wherein the plurality of coupling columns of the casing are fitted with the plurality of fitting orifices of the body to form a plurality of inserting apertures, hence each of the plurality of screwdrivers is inserted into each of the plurality of inserting apertures.

* * * * *